United States Patent [19]

Temmer

[11] Patent Number: 5,058,169

[45] Date of Patent: Oct. 15, 1991

[54] PUBLIC ADDRESS SYSTEM

[76] Inventor: Stephen F. Temmer, 767 Greenwich St., New York, N.Y. 12834

[21] Appl. No.: 430,018

[22] Filed: Nov. 1, 1989

[51] Int. Cl.[5] ..... H04R 1/02

[52] U.S. Cl. ..... 381/82; 381/90; 381/188; 381/205; 181/144; 181/153; 181/196

[58] Field of Search ..... 181/141, 144, 153, 145, 181/196, 197; 381/88, 89, 90, 82, 159, 182, 188, 205

[56] References Cited

FOREIGN PATENT DOCUMENTS

| | | | |
|---|---|---|---|
| 1244807 | 7/1986 | U.S.S.R. | 381/82 |
| 757021 | 9/1956 | United Kingdom | 181/144 |
| 846968 | 9/1960 | United Kingdom | 181/144 |

*Primary Examiner*—Forester W. Isen

*Attorney, Agent, or Firm*—Kane Dalsimer Sullivan Kurucz Levy Eisele and Richard

[57] ABSTRACT

A public address system which consists of a longitudinal tubular member extending through an area serviced by the system, with a longitudinal opening and having a plurality of speakers spaced at regular intervals. The audio signals generated from the speakers are emitted through the opening in any direction desired. The speakers are hidden from view within the tubular member and by a cover on the opening which further protects the speakers from ambient contamination. Preferably, the tubular member consists of modular sections, each section including at least one speaker. The speakers may be controlled through a speaker control circuit.

25 Claims, 4 Drawing Sheets

PUBLIC ADDRESS SYSTEM

BACKGROUND OF THE INVENTION

1. Field of Invention

This invention pertains to a public address system, and more particularly to a public address system especially useful in locations, wherein echoes, acoustic resonance and large spaces hamper the transmission of audio signals from regular speakers.

2. Description of the Prior Art

Public address systems are frequently used in various public places including subway stations, railway stations, tunnels, airports, and so on, for making announcements and/or playing background music. Most of these systems include a plurality of speakers which are substantially used as point sound sources. These locations have generally very large volumes, including high ceilings, and poor acoustic characteristics so that the audio signals emitted by the speakers are dissipated in undesirable directions and are echoed so that they frequently become unintelligible. Furthermore, if these speakers are exposed they can be subjected to unauthorized tampering and even vandalism.

OBJECTIVES AND SUMMARY OF THE INVENTION

In view of the above mentioned disadvantages of the prior public address systems, it is an objective of the present invention to provide an improved public address system which directs audio signals toward the public.

A further objective is to provide a public address system which distributes audio signals uniformly so as to improve the reception and clarity of these signals.

Yet, another objective is to provide a modular speaker assembly for a public address system whereby several such assemblies may be coupled as desired.

Other objectives and advantages of the invention shall become apparent from the following description of the invention. Briefly, a public address system constructed in accordance with this invention comprises a tubular member extending through the area to be serviced by the system. The tubular member has an opening facing any desired direction. For example, if the system is secured to a ceiling, the opening is directed downward to direct sound to the people below. Within the tubular member there are several speakers disposed at preselected intervals. The speakers may be selectively activated through a control circuit.

Preferably, the tubular member consists of a plurality of modular sections connected end-to-end to form a public address system of any desired length.

DETAILED DESCRIPTION OF THE INVENTION

Figure 1:
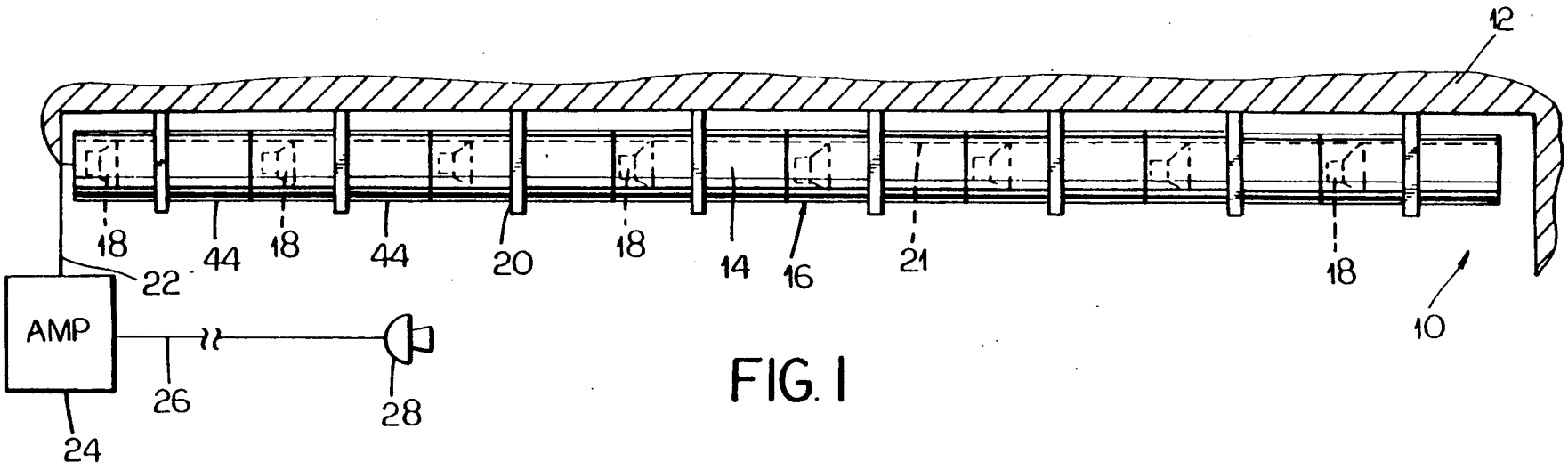
FIG. 1 shows somewhat a schematic of an improved public address system constructed in accordance with this invention and installed in a large location.

Referring now to the drawings, FIG. 1 shows a public address system constructed in accordance with this invention and installed in a relatively large public area 10 having a ceiling 12. Suspended from the ceiling substantially along the entire length of the area 10, there is a tubular member 14. Member 14 can have a circular, elliptical, square, rectangular or any other geometric shape as desired, and may have cross-sectional dimensions, for example, in the range of 5–10 inches. Member 14 has along its length a longitudinal opening or slot 16. For example, at regular intervals, such as every 8–15 feet within member 14, there is a speaker 18 provided for generating audio signals. The member 14 is supported by straps 20, rods or other similar means attached to ceiling 12. Member 14 may be made of materials readily available in the industry, including fire resistant materials, such as sheet rock, Transite, Eternit, or extruded aluminum, in which slot 16 is made by grinding, sawing, milling and so on (depending on the actual material used). Slot 16 is provided to direct audio signals out of the member 14, in a preselected direction. For example, if the slot is disposed on the bottom of member 14, then audio signals from member 14 are directed downward. As describe below, means may be provided on the member 14 for directing the audio signals in other directions.

Within member 14 there is also a cable of wires 21 for providing electrical signals to the speakers. This cable is also connected through a conduit 22 to an amplifier 24. The amplifier 24 is also connected by a second cable 26 to a source of electrical signals corresponding to the audio signals to be reproduced by speakers 18. For example, cable 26 may be connected to a microphone 28. The microphone 28 may be in the same physical location as area 10, or it may be at a geographically remote location, in which case the electrical signals may undergo various signal processing before transmission to the amplifier. For the purposes of this discussion, it will be assumed that the microphone 28 is in the vicinity of area 10.

Figure 2:
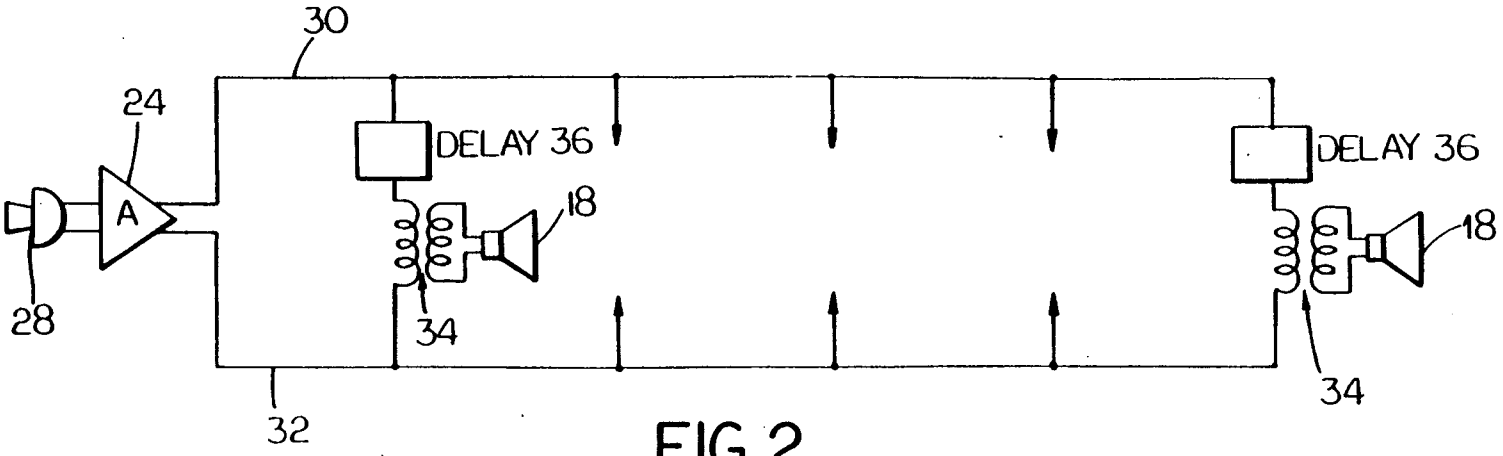
FIG. 2 shows an electrical connection diagram for the public address system of FIG. 1.

As shown in FIG. 2, microphone 28 is connected to amplifier 24. Amplifier 24 amplifies the electrical signals from microphone 28, and transmits them over a pair of wires 30, 32. Wires 30, 32 form cable 21 which, as mentioned above, preferably runs along the length of member 14 in FIG. 1.

Each speaker 18 is connected in parallel across wires 30, 32, either directly, or through a suitable audio transformer 34. For example, the electrical signals on line 30, 32 may be in the range of 70–100 V(rms) in which case transformer 34 may be used to step down these signals to the impedance of the voice coil of speaker 18. To improve the performance of the system, at each speaker, the system may also include a delay element 36. The delay element 3 delays the audio signals to the corresponding speaker 18 by a differential time period selected to compensate for time that it takes for sound to travel from one speaker to the next. For even better results, this delay may be increased by about 14–20 msec to take advantage of the well-known Haas or precedence effect.

Figure 3:
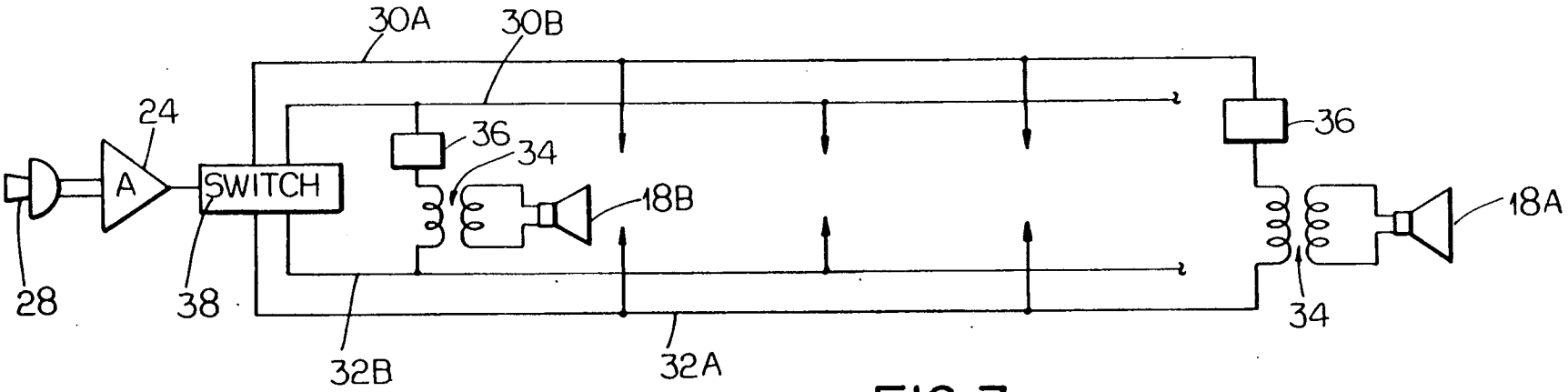
FIG. 3 shows an alternate connection diagram for the public address system of FIG. 1.

In some applications it may be necessary to activate the speakers selectively. For example, if the public address system of FIG. 1 is used in a facility adjacent to a residential area, the total level of audio signals should be reduced at night time when the ambient noise level is reduced, and a high sound level may interfere with the people. For this purpose, as shown in FIG. 3, two sets of wires may be provided, 30A, 32A, and 30B, 32B, each being connected to amplifier 24 through a switch 38. Alternate speakers can then be connected to the wires, so that, for example, speakers 18A are connected to wires 30A, 32A, and speakers 18B are connected to wires 30B, 32B. Switch 38 then may be used to selectively activate either all the speakers, or only half the speakers, either 18A or 18B. If desired more wires may be provided to achieve even more discriminating control over the speakers such as restricting the length over which the speakers are active. Of course, the most complete and expensive control could be achieved using a discrete pair of wires for each speaker.

Figure 4:
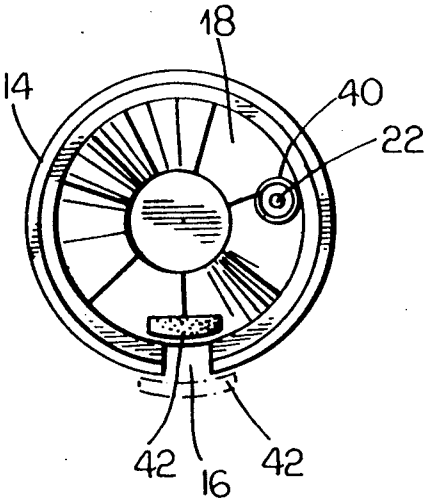
FIG. 4 shows an end view of the member 14 of FIG. 1.

As shown in FIG. 4, preferably cable 22 should be arranged within member 14, away from slot 16 so that it does not interfere with the transmission of the audio signals. For example, if the slot 16 is on the bottom of the member 14, cable 22 may be secured to a lateral side of member 14 by any means well known in the art. Cable 22 may be installed directly inside member 14, or it may be installed through a duct 40 made of a metallic or non-metallic material.

The public address system described herein may be installed in a relatively dirty environment, such as for example a subway station, where steel or other particles are generated which may deposit on the speaker magnets. In order to protect the speakers and other elements of the system from these particles, as well as from other dirt or even vandalism, the slot may be covered by a suitable protective layer or filter 42. The filter 42 may be installed either on the inside or outside of the member 14, and may consist of one or more layers of a metal gauze, with a dense cloth or membrane to make member 14 waterproof. In this manner the member may be cleaned easily, for example by hosing it down with water. The filter must be able to intercept the particulate matter without substantially interfering with the transmission of the audio signals.

Figure 5:
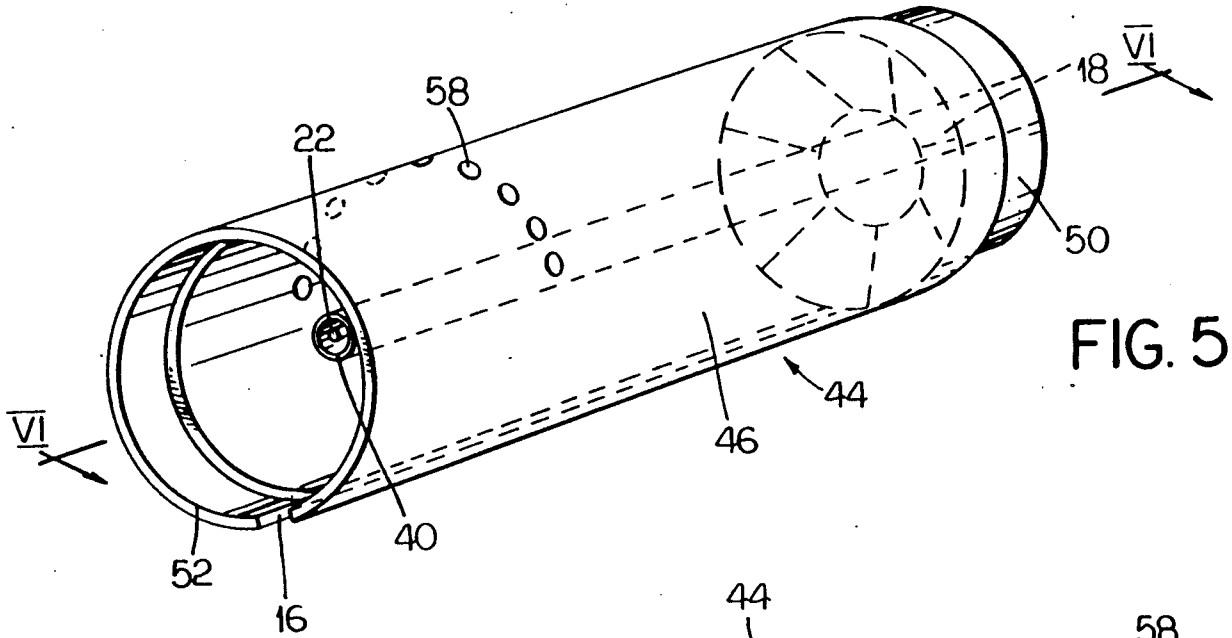
FIG. 5 shows a perspective view of a speaker assembly which may be used for the public address system of FIG. 1.
Figure 6:
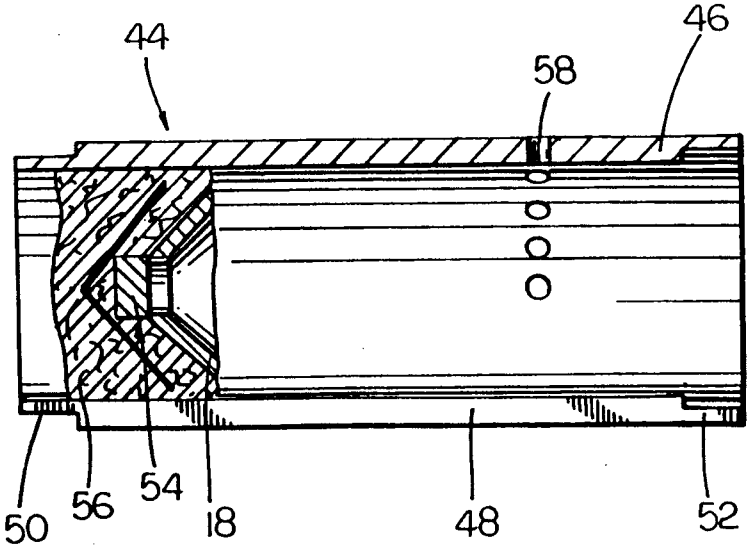
FIG. 6 shows a side-sectional view of the speaker assembly of FIG. 5.

In a particularly advantageous aspect of the invention, the tubular member 14 is made of a plurality of modular speaker assemblies 44. As shown in FIG. 5 and 6, each assembly 44 includes a tubular wall 46, with a longitudinal slot 16. (For the sake of clarity, the filter 42 has been omitted in FIGS. 5 and 6). One end 50 of the wall 44 has a reduced cross-section while the other end 52 is enlarged. This structure permits one assembly 44 to be connected to another by the telescoping engagement of the corresponding ends 50, 52. In this manner several assemblies (as many as required) can be connected to form tubular element 14, with slot sections 16 being aligned.

Each speaker assembly 44 also includes a speaker 18, which may be disposed either somewhere at the longitudinal center of the wall 46, or adjacent to one of the ends, as shown in FIG. 6.

Mounted on the rear of speaker 18 is an enclosure 54 for housing the magnet for the speaker as well as the transformer 34. Alternatively, the transformer (and delay element 36 if used) may be disposed separately outside speaker assembly 44.

Provided behind speaker 18, there is an acoustic termination including a filling 56 made of a porous material to absorb and dampen sound projecting from speaker 1 into the next assembly.

Assembly 44 may also be provided circumferentialy with a plurality of mounting holes 58 for mounting the assembly. These holes allow the assembly to be mounted with slot section 16 disposed at any desired angle for projecting sound in a corresponding direction.

From the above description, it should be appreciated that the subject public address system emits audio signals in a preselected direction, thereby, reducing the power required for driving the speakers. Furthermore, the longitudinal slot through the tubular member 14 distributes the sound evenly through the space and eliminates, or reduces echoes considerably. The speakers themselves are hidden from view so that they are not exposed to the ambient environment, and are protected from vandalism.

Figure 9:
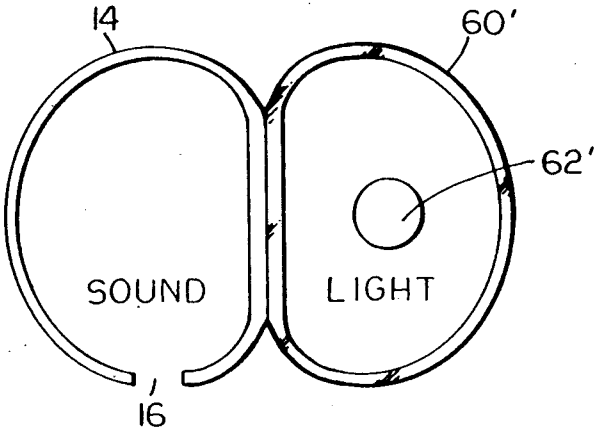
FIGS. 7–9 show various embodiments of a speaker assembly combined with a lighting system.
Figure 8:
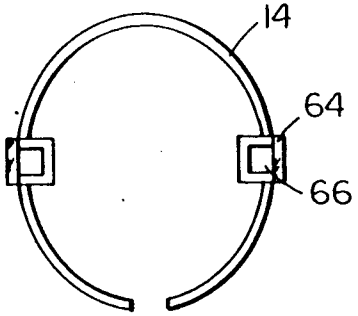
Figure 7:
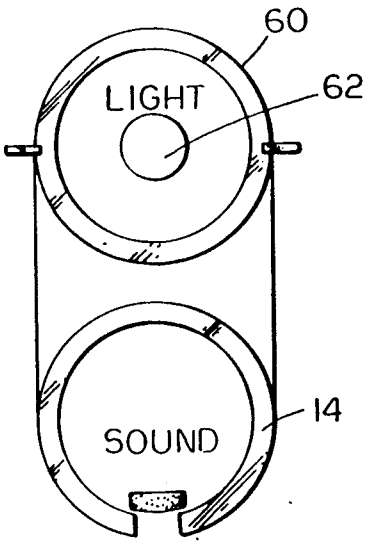

The tubular member 14 may be made aesthetical attractive by decorations, or it may be naturally blended in with other artistic and/or functional fixtures of the area. For example, member 14 may be connected to or manufactured integrally with a lighting system. As shown in FIG. 7, member 14 may be hung from or secured to a tubular transparent lighting element 60 holding for instance, a fluorescent bulb 62. In this configuration, the tubular member itself may be made of a transparent or translucent material. Alternatively, as shown in FIG. 8, member 14 may be made with one or more longitudinal grooves or slots 64 for holding a lighting track 66. Finally, in another embodiment shown in FIG. 9, a lighting tube 60' with a fluorescent bulb 62' may be mounted side-by-side or in tandem with the member 14, so that they can share a common support system.

Figure 11:
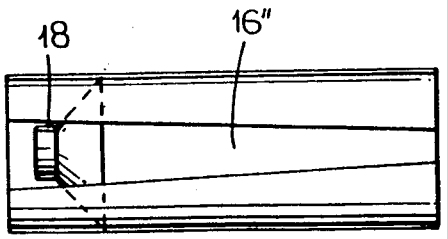
FIG. 11 shows a second alternative embodiment for a slot.
Figure 10:
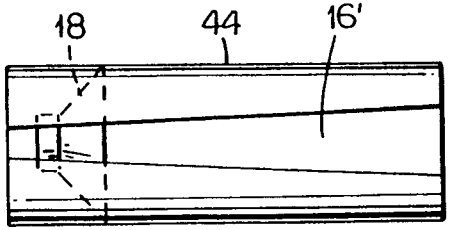
FIG. 10 shows a first alternative embodiment for a slot.

The longitudinal slot section 16 for each assembly 44 can have a constant cross-sectional width. Alternatively, the slot may vary in width to compensate for the distance to the speaker 18. For example, as shown in FIG. 11, the slot 16' may be widest adjacent to the speaker and become gradually narrower. Alternatively, as shown in FIG. 10, the slot 16' may be narrowest adjacent to the speaker 18, and become gradually wider.

Figure 12:
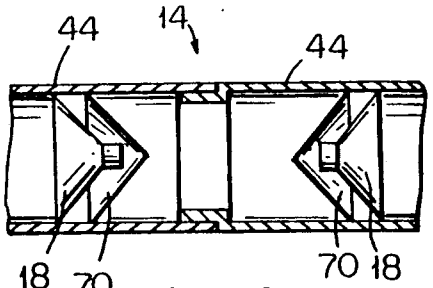
FIG. 12 shows two speaker assemblies coupled back-to-back.

In the embodiment of FIG. 1, the modular assemblies 44 are mounted so that the speakers project sound in the same direction along the longitudinal axis of member 14. In some instances however, the system may be more effective if two speakers 18, 18" are mounted back to back as shown in FIG. 12 so that adjacent speakers 18 project sound in opposite directions. In this latter embodiment, more substantial acoustic termination 70, such as a fiberglass wedge or a cone, is more effective.

Obviously, numerous modifications may be made to the invention without departing form its scope as defined in the appended claims.

What is claimed is:

1. A public address system for emitting audio signals in a large area, comprising:

a. a tubular member disposed along said area, and having opening means extending substantially along the length of said tubular member; and b. a plurality of acoustically coupled speakers mounted coaxially within said tubular member generally parallel to said tubular member axis at preselected intervals within said tubular member for generating audio signals, said speakers and opening means being arranged and constructed for emitting said audio signals through said opening means.

2. The public address system of claim 1 further comprising cover means for covering said opening means to protect said speakers.

3. The public address system of claim 1 further comprising a source of electrical signals for generating electrical signals corresponding to said audio signals, and amplifier means for amplifying said electrical signals for said speakers.

4. The public address system of claim 1 further comprising control means for selectively activating said speakers.

5. The public address system of claim 1 wherein said tubular member comprises a plurality of interfitted modular sections, each modular section including a speaker.

6. A public address system for emitting audio signals in a large area, comprising:

a. a first tubular member with longitudinal opening means;

b. support means for supporting said first tubular member in said large area;

c. a plurality of acoustically coupled speakers coaxially mounted within said tubular member generally parallel to said tubular member axis for emitting audio signals through said longitudinal opening and d. speaker control means for activating said speakers.

7. The public address system of claim 6 wherein said speakers are partitioned into a first group of speakers and a second group of speakers, said control means selectively activating at least one of said first and said second group of speakers.

8. The public address system of claim 7 wherein speakers of said first group are alternated with speakers from said second group along said first tubular member.

9. The public address system of claim 6 further comprising wire means extending through said first tubular member from said speaker control means to said speakers.

10. The public address system of claim 6 further comprising:

e. a second tubular member disposed in parallel and coupled with said first tubular member; and f. light source means disposed in said second tubular member for generating light.

11. The public address system of claim 10 wherein said first tubular member is disposed below said second tubular member.

12. The public address system of claim 11 wherein said first tubular member is made of a translucent material.

13. The public address system of claim 10 wherein said first and second tubular members are connected side by side.

14. The public address system of claim 6 wherein first tubular member has a sidewall, further comprising a lighting system secured to said sidewall.

15. The public address system of claim 6 wherein said control system includes delay means for delaying the electrical signals to at least one speaker by a preselected duration.

16. A speaker assembly comprising:

a. a tubular section having a first open end, a second open end opposite said first end, and longitudinal opening means extending between said first and second ends; and b. a speaker disposed in said tubular section for emitting audio signals which exit through said opening means;

said first and second end being arranged and constructed so that a plurality of speaker assemblies could be connected end to end to form a public address system.

17. The speaker assembly of claim 16 wherein speaker is arranged and constructed to emit audio signals toward said first open end.

18. The speaker assembly of claim 17 further comprising baffle means between said speaker and said second end for dampening sound from said speaker toward said second end.

19. The speaker assembly of claim 16 wherein said first and second ends are constructed to permit the first end of one speaker assembly to be inserted telescopically into the second end of another speaker assembly.

20. The speaker assembly of claim 16 wherein said tubular section further includes a side wall and a plurality of mounting holes disposed about said side wall for mounting said speaker assembly at a preselected angle.

21. The speaker assembly of claim 16 further comprising cover means for covering said opening means.

22. The speaker assembly of claim 16 wherein said opening means comprises a longitudinal slot.

23. The speaker assembly of claim 22 wherein said slot has constant cross-sectional dimension.

24. The speaker assembly of claim 22 wherein said slot has a cross-sectional dimension which increases as the slot extends away from the speaker.

25. The speaker assembly of claim 22 wherein said slot has a cross-sectional dimension which decreases as the slot extends away from the speaker.

* * * * *